United States Patent [19]

Seko

[11] Patent Number: 4,726,168

[45] Date of Patent: Feb. 23, 1988

[54] METHOD AND APPARATUS FOR CONTROLLING A DRIVING SYSTEM IN A PACKAGING MACHINE

[75] Inventor: Kiyoshi Seko, Nagoya, Japan

[73] Assignee: Fuji Machinery Company, Ltd., Nagoya, Japan

[21] Appl. No.: 857,874

[22] Filed: May 1, 1986

[30] Foreign Application Priority Data

May 8, 1985 [JP] Japan ..... 60-97193

[51] Int. Cl.[4] ..... B65B 9/08; B65B 57/14; B65B 57/10; B65B 41/18

[52] U.S. Cl. ..... 53/450; 53/51; 53/64; 53/550; 53/389

[58] Field of Search ..... 53/450, 389, 55, 51, 53/550, 64, 551, 552

[56] References Cited

U.S. PATENT DOCUMENTS

| | | | |
|---|---|---|---|
| 4,506,488 | 3/1985 | Matt et al. | 53/55 |
| 4,525,977 | 7/1985 | Matt | 53/450 X |
| 4,574,566 | 3/1986 | Eaves et al. | 53/55 X |

*Primary Examiner*—Horace M. Culver
*Attorney, Agent, or Firm*—Schwartz & Weinrieb

[57] ABSTRACT

A method and apparatus are presented for controlling a driving system in a packaging machine. The method comprises providing a first motor for driving an article infeed conveyor for feeding articles to be packaged into a tube of packaging material, a second motor for driving a pair of rollers for drawing a film of packaging material and a third motor for driving a pair of sealing heads at an end seal mechanism and controlling the speed of the second motor and the speed of the third motor to be dependent upon the speed of the first motor. Apparatus for performing the method is disclosed which comprises a first motor for driving an article infeed conveyor for feeding articles to be packaged into a tube of packaging material, a second motor for driving a pair of rollers for drawing a film of packaging material and a third motor for driving a pair of sealing heads at an end seal mechanism, and a control circuit for storing and processing various data such as the speed of the first motor and the cut pitch for the film. The control circuit produces a film speed control signal and a sealing head speed control signal to control the speed of the second motor and the speed of the third motor, respectively, so as to be dependent upon the speed of the first motor.

4 Claims, 4 Drawing Figures

METHOD AND APPARATUS FOR CONTROLLING A DRIVING SYSTEM IN A PACKAGING MACHINE

BACKGROUND OF THE INVENTION

1. Field of the Invention

The present invention relates to a method and apparatus for controlling drives in a packaging machine which may simplify the driving mechanism of the packaging machine so as to reduce manufacturing steps and costs, and which may facilitate adjustments of speeds and other factors responsive to changes in articles to be packaged.

2. Description of the Prior Art

One type of machines in which the invention may be used is a machine of the so-called horizontal form-fill-seal class (hereinafter referred to as a horizontal packaging machine) in which a film of packaging material is supplied from a roll and drawn past a former which shapes the film into a continuous tube of packaging material, an article to be packaged is supplied through the former into the tube, and the tube is fed downstream, sealed to form a longitudinal tube seal on its two longitudinal edge portions, and ultimately sealed at package length intervals so as to form transverse seals and cut into individual packages. In such prior art horizontal packaging machines, different sections of the machine are driven by a single main motor. In this branch of the art, the heat seal formed longitudinally with respect to the direction of film advancement is referred to as the "center seal" and the seal formed transversely to the direction of film advancement is referred to as the "end seal", and these terms will be used herein and in the claims.

FIG. 1 is a schematic plan view of one typical driving system of the horizontal packaging machine and as may be seen, the driving system includes two drives which are powered by a single main motor 10. The first drive is a drive for an article infeed conveyor 12 and an end seal mechanism 14. Power is transmitted from the main motor 10 to a main shaft 16. The power is then transmitted through power transmission elements, such as chains and sprockets, to a drive shaft 18 for the article infeed conveyor 12 and a drive shaft 20 for the end seal mechanism 14, so that the respective mechanisms may be driven at the required speed. The second drive is a drive to feed a continuous film of packaging material (main plastic film), which drives a drive shaft 24 for a pair of rollers 22 for drawing the film from a supply roll, through power transmission elements such as timing belts and pulleys, to thereby feed the film of packaging material forward, and continuously form the same into a tube.

At this point, the speed of the article infeed conveyor 12 is so determined that the operation per pitch of an article pusher which serves to position the articles at predetermined intervals may be performed in timed relationship with each rotation of seal heads 26 in the end seal mechanism 14 (in the case that the rotary shaft has a single seal head). The rotation of the seal heads 26 has to be synchronized with the feed speed of the film of packaging material, at least while the seal heads are in contact with the tube of packaging material so as to seal (and cut) the same. To this end, a non-uniform mechanism 28 including an eccentric crank and other complicated elements is provided and is driven by a pilot motor 29 to regulate the speed of the seal heads 26.

Further, during the cutting operation by the end seal mechanism 14, the cutting locations have to be properly controlled so that they may depart from the pattern printed on the film of packaging material. To this end, the film of packaging material has register marks printed thereon which are sensed by a sensor. Thus, the sensed timing is compared with a value sensed by a photoelectric sensor 32 for a timing cam 30, to thereby control a pilot motor 36 for a speed-change pulley 34 and a pilot motor 40 for a differential gear mechanism 38. Additionally, the timing cam 30 is automatically set by a pilot motor 42.

It is to be noted that the main motor 10 also serves to drive a pair of rollers 44 for drawing the film of packaging material, another pair of rollers 46 for forming a center seal on the film and a discharge conveyor 48 for discharging the wrapped article.

Thus, the construction of known horizontal packaging machines is relatively complex in that power is transmitted from a common motor to many operating mechanisms, and the speed of each operating mechanism is varied by differential gear mechanisms and non-uniform speed mechanisms, and hence the machines require considerable labor and time to assemble. This may lead to malfunctions or operative difficulties with the machine. Also, the use of automatic regulating mechanisms in the form of pilot motors may lead to increased manufacturing costs.

Further, in the known horizontal packaging machines, it is necessary, when processing one article having a predetermined size which is different than a predetermined size of another article, to adjust the eccentricity of the crank in the non-uniform mechanism 28 for the end seal mechanism 14 so as to change the speed of the seal heads 26. However, it is mechanically difficult to make any substantial processing changes. For example, it is extremely difficult for a single motor to be employed so as to slowly feed a tube of packaging material in which a long article is wrapped and to effect end seals and cuttings on the tube. Additionally, the printed pattern registration has to be readjusted so as to be responsive to changes in the packaging materials and articles. Again, a substantial alteration is mechanically impossible.

European Patent Publication No. 83912 A1 discloses a packaging machine wherein the seal heads are driven by a first electric motor and the film of packaging material is driven by a second electric motor. However, the subject invention is directed to the specific arrangement wherein the first electric motor is dependent upon the second electric motor, and the machine of the publication is technically different from the present invention which will be hereinafter described.

OBJECTS OF THE INVENTION

It is therefore an object of the present invention to overcome the above noted problems encountered in the prior art wrapping machines by providing an improved driving system for a packaging machine which is simple in construction and which facilitates adjustments of each operating section.

It is another object of the present invention to provide apparatus for controlling a driving system in a packaging machine which enables the rotational speed to be readily changed over a wide range and which is less expensive to manufacture.

SUMMARY OF THE INVENTION

In accordance with the present invention, there is provided a method of controlling a driving system in a packaging machine of the type having a former for shaping a film of packaging material drawn past the former into a continuous tube, an article infeed conveyor adapted to feed articles to be packaged through the former for formation into the continuous tube of packaging material, a pair of rollers for drawing the film of packaging material past the former and past an end seal mechanism, and a pair of sealing heads at the end seal mechanism for sealing and cutting the continuous tube of packaging material. The method comprises the steps of providing a first motor for the article infeed conveyor, a second motor for driving the rollers for drawing the film and a third motor for driving the sealing heads, providing a control circuit for storing and processing various data such as the speed of the first motor for driving the conveyor and the cut pitch for the film of packaging material, and producing from the control circuit a film speed control signal and a sealing head speed control signal such that the speed of the second motor for driving the rollers for drawing the film and the speed of the third motor for driving the sealing heads are dependent upon the speed of the first motor for the article infeed conveyor, respectively.

Also, in accordance with the present invention, there is provided apparatus for controlling a driving system in a packaging machine of the type having a former for shaping a film of packaging material drawn past the former into a continuous tube, an article infeed conveyor adapted to feed articles to be packaged through the former so as to be disposed within the continuous tube of packaging material, a pair of rollers for drawing the film of packaging material past the former and past an end seal mechanism, and a pair of sealing heads at the end seal mechanism for sealing and cutting the continuous tube of packaging material, wherein the system comprises a first motor for driving the article infeed conveyor, a second motor for the rollers for drawing the film, a third motor for driving the sealing heads, and a control circuit for storing and processing various data such as the speed of the first motor for driving the conveyor and the cut pitch for the film of packaging material, the control circuit producing a film speed control signal and a sealing head speed control signal such that the speed of the second motor for driving the rollers for drawing the film and the speed of the third motor for driving the sealing heads are dependent upon the speed of the first motor for the article infeed conveyor, respectively.

BRIEF DESCRIPTION OF THE DRAWINGS

The invention will now be described by way of example and with reference to the accompanying drawings, in which.

DETAILED DESCRIPTION OF THE INVENTION

Figure 1:
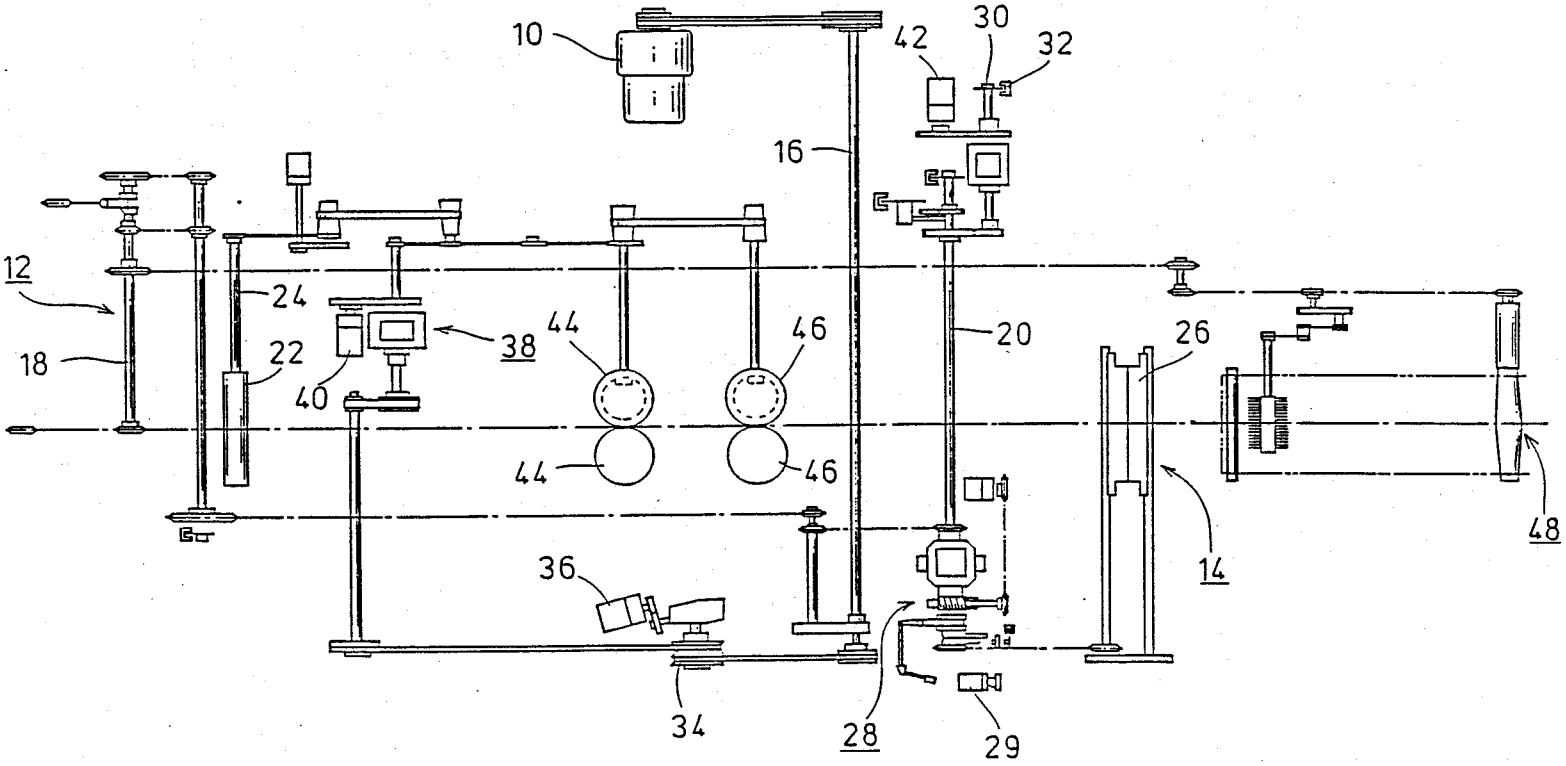
FIG.1 PRIOR ART
FIG. 1 is a schematic plan view of an example of the driving system of a conventional horizontal packaging machine.
Figure 2:
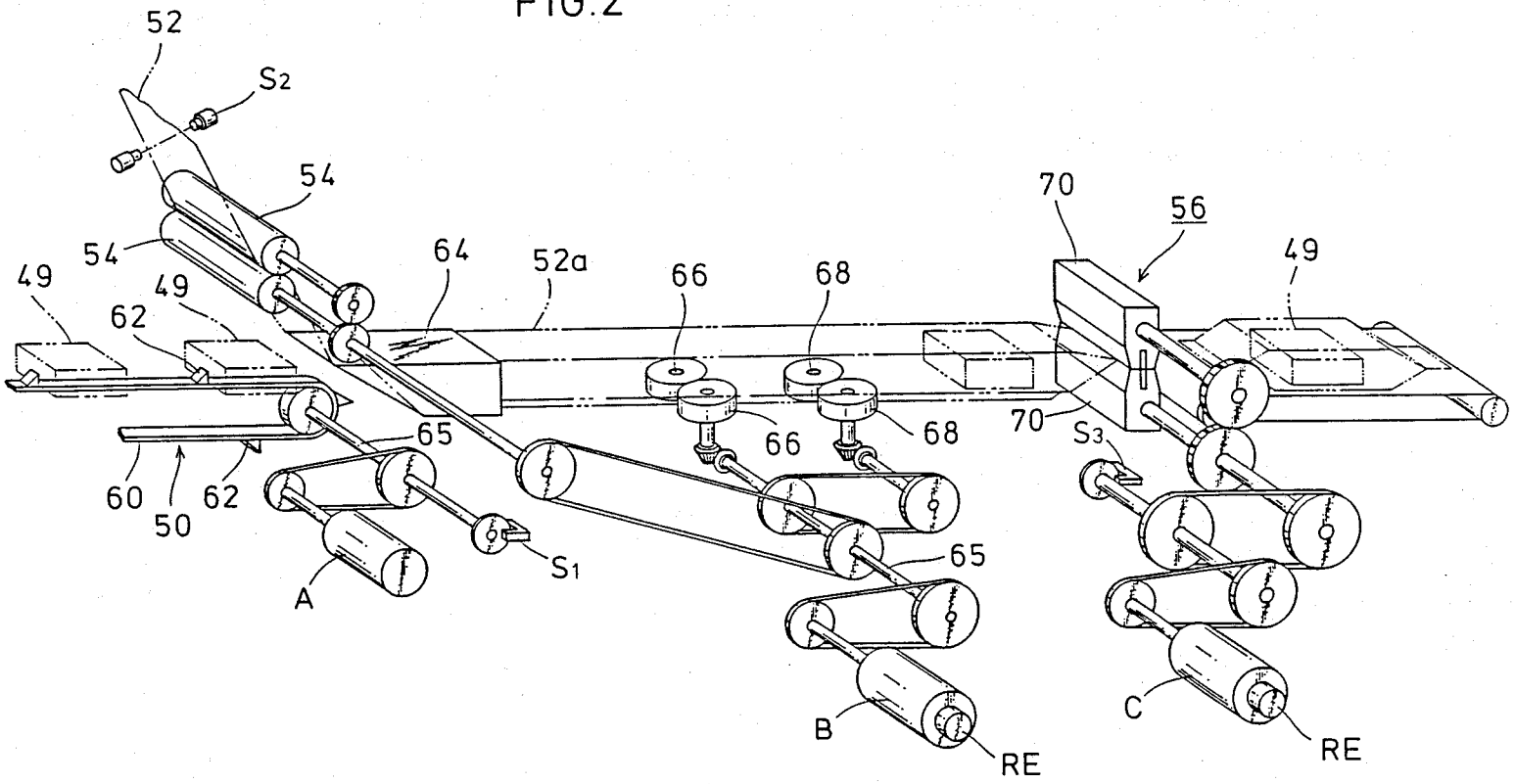
FIG. 2 is a schematic perspective view of apparatus for controlling a driving system in a packaging machine according to the present invention.
Figure 3:
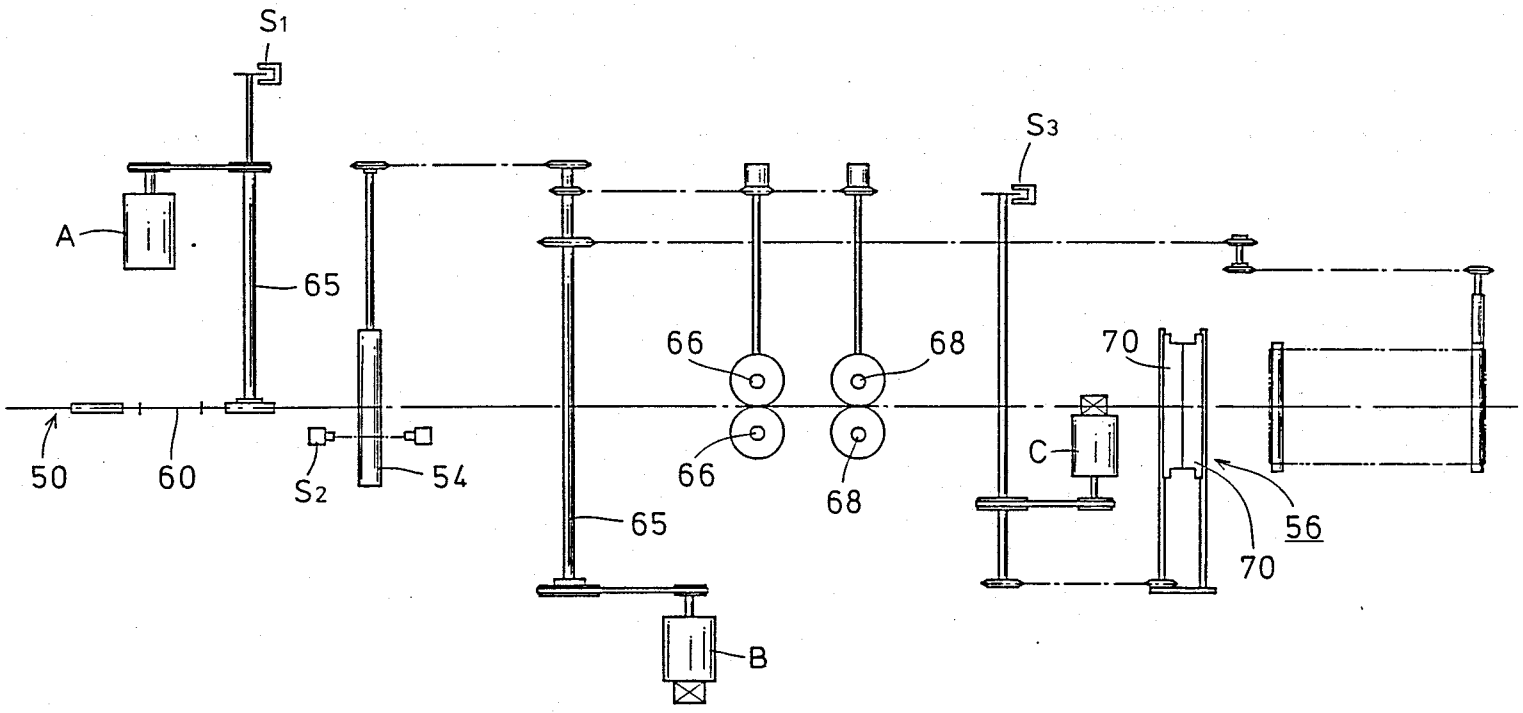
FIG. 3 is a plan view of the driving system control apparatus shown in FIG. 2.
Figure 4:
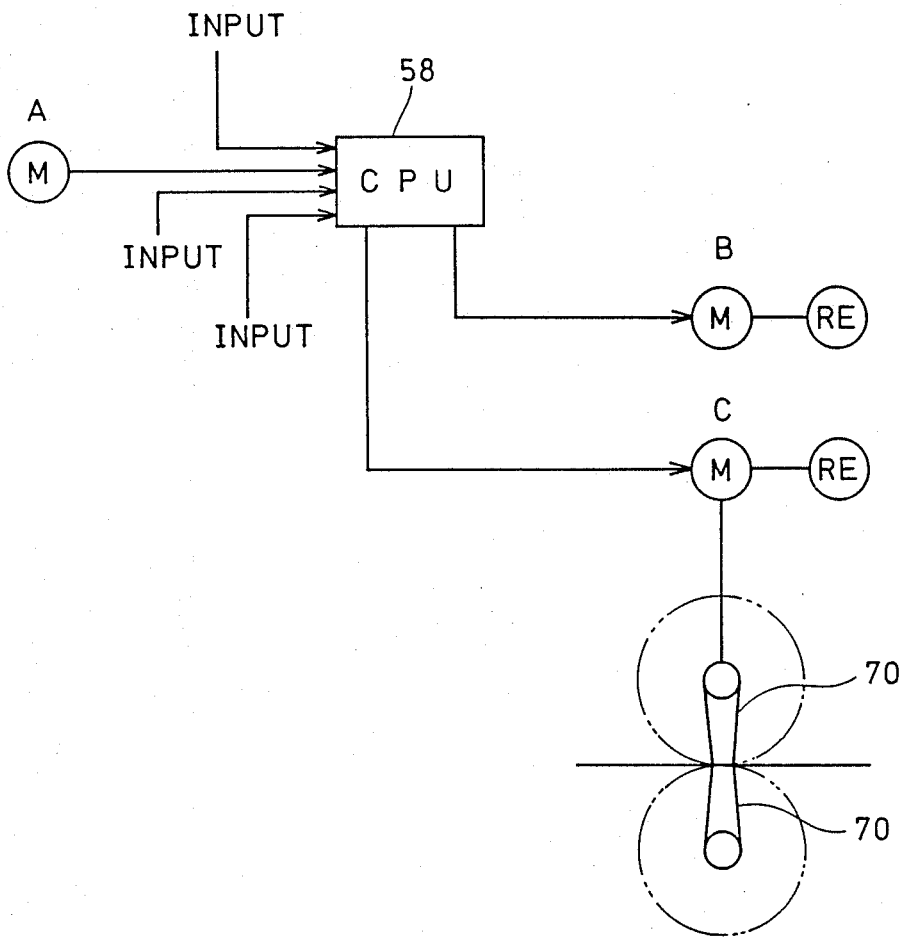
FIG. 4 is a block diagram of the control circuit for controlling the motors B and C incorporating a central processing unit of a microprocessor.

The invention method of controlling a driving system in a packaging machine will now be described with reference to FIGS. 2 to 4 which illustrate one preferred embodiment of the system for performing the method. Referring first to FIG. 2, shown therein is one embodiment of the driving system controlling apparatus of the invention as applied to a horizontal packaging machine. As shown therein, the driving system of the machine includes a first motor A which serves to drive an article infeed conveyor 50 for supplying articles 49, a second motor B which serves to mainly drive a pair of rollers 54 for drawing a film 52 of packaging material, and a third motor C which serves to drive an end seal mechanism 56. As shown in FIG. 4, the driving system also includes a control circuit 58 wherein the number of revolutions of the first motor A and various other data such as, for example, the cut pitch for the film of packaging material, are stored and processed. The control circuit 58 serves to generate speed control signals to control the speed of the second motor B for drawing the film 52 of packaging material and to control the speed of the third motor C for driving the end seal mechanism 56.

Specifically, the article infeed conveyor 50 includes an endless chain 60 and a plurality of article pushers 62 secured thereto at predetermined pitches. By means of this arrangement, the articles 49 are continuously fed downstream at predetermined intervals to a former 64 which will be described later. The conveyor 50 is driven by the motor A through means of a power transmission mechanism having chains and sprockets and provided on a drive shaft 65. The drive shaft 65 includes a supply origin sensor S1 operable to monitor the position of the article pushers 62 on the conveyor 50 at all times.

The former 64 is disposed downstream of the article infeed conveyor 50 and is employed to shape the film 52 of packaging material fed from a supply roll (not shown) into a tube 52*a*. As may be seen in FIG. 2, the rolls 54 for positively drawing the film 52 of packaging material are driven by means of the second motor B through means of a power transmission system including timing belts and pulleys. Power from the motor B is branched through a drive shaft 65 so as to synchronously drive a pair of feeding rolls 66 serving to hold therebetween the longitudinally overlapping edges of the tube 52*a* and feed the same downstream, and a pair of sealing rolls 68 for forming center seals. The speed of the motor B is detected by a rotary encoder RE at all times and the detected value is fed back to the control circuit 58 so as to thereby control the speed of the motor B.

While not shown, the film 52 of the packaging material has register marks printed at predetermined intervals on its longitudinal edge portion. The marks are read and detected by means of a sensor S2 including photoelectric cells, as shown in FIG. 2.

The end seal mechanism 56 includes a pair of sealing heads 70 which are driven by means of the third motor C through a transmission system including chains and sprockets. As with the second motor B, the speed of the third motor C is detected by a rotary encoder RE and the detected value is fed back to the control circuit 58 to thereby control the speed of the motor C. A cutter origin sensor S3 is provided in the drive system so as to rotate the sealing heads 70 and on the basis of signals detected by the cutter origin sensor S3, the printed pattern registration is effected. Specifically, when the mark of the film 52 of packaging material passes the sensing surface of the sensor S2 at a relatively high rate of speed, the sensor S2 detects the value and issues a speed reduction instruction to the motor B through the control circuit 58. Conversely, when the mark of the film 52 passes the sensing surface of the sensor S2 at a relatively low rate of speed, the sensor S2 detects the value and issues an acceleration instruction to the motor B through the control circuit 58.

As shown in FIG. 4, the control circuit 58 for controlling the motors B and C includes a central processing unit (CPU) of a microprocessor, the CPU has stored therein various numerical data such as the speed of the motor A, the length and height of the product 49, the cut pitch of the film 52 determined by the cut length for each package, and the radius of the sealing heads 70 in the end seal mechanism 56. The CPU processes the data thus stored and delivers instructions signals obtained thereby to the motors B and C. Thus, the motors B and C are controlled in synchronism with the motor A through the CPU of the control circuit 58. In this sense, the motor A serves as a reference of the synchronization with respect to the motors B and C.

Specifically, the article infeed conveyor 50 is driven by the motor A, the master motor, to deliver the articles 49 at a predetermined speed, the articles 49 being fed into the tube **52*a* of packaging material and wrapped therein. At this point, the motor B is operable to drive the rolls 54 for feeding the film 52 of packaging material forward one package length increment (which is processed on the basis of the cut length and other data previously stored in the CPU). In this sense, the motor B is dependent upon the motor A for driving the conveyor 50**.

The motor C is controlled such that the peripheral speed during each rotation of the sealing heads 70 coincides with the feed speed of the tube **52*a* of the packaging material with the article 49 wrapped therein, at least while the sealing heads 70 perform the end sealing (and cutting) operation on the tube 52*a* of the packaging material. For this reason, the peripheral speed of the sealing heads 70 is as a whole non-uniform, but practically, each sealing head 70 makes one revolution every time one article 49 is fed from the conveyor 50. In this sense, the motor C is dependent upon the motor A which drives the conveyor 50**. It is to be noted that there is no dependent relationship between the motors B and C.

From the foregoing detailed description, it can be appreciated that the method and apparatus of the invention offers the possibility of providing a very simple arrangement of drives in a packaging machine and eliminating the need for complex mechanisms such as non-uniform mechanisms and differential gear mechanisms, since the motor for drawing the film of packaging material and the motor for driving the sealing heads are controlled so as to be dependent upon the motor for driving the article infeed conveyor, respectively. Therefore, the system is less expensive to manufacture and yet the speed of each operating section may be greatly altered as necessary. Additionally, adjustments of the operating sections can be made simply as compared with the known system which requires considerable labor and time for adjustments.

Obviously many modifications and variations of the present invention are possible in light of the above teachings. It is therefore to be understood that within the scope of the appended claims, the present invention may be practiced otherwise than as specifically described herein.

What is claimed is:

1. A method of controlling a driving system in a packaging machine of the type having a former for shaping a film of packaging material, drawn past the former, into a continuous tube; an article infeed conveyor adapted to feed articles, to be packaged within said former, into said continuous tube of packaging material; a pair of rollers for moving said film of packaging material toward said former and toward an end seal mechanism; and a pair of sealing heads at said end seal mechanism for sealing and cutting said continuous tube of packaging material, comprising the steps of:

providing a first motor for driving said article infeed conveyor, a second motor for driving said rollers for moving said film, and a third motor for driving said sealing heads, said first, second and third motors forming said driving system of said packaging machine;

providing a control circuit for continuously sensing and storing speed data from said first motor for driving said article infeed conveyor; and continuoulsy generating from said control circuit a film speed control signal and a sealing head speed control signal for controlling the speed of said second motor for driving said rollers for moving said film, and the speed of said third motor for driving said sealing heads, respectively, at a speed value which is continuously dependent upon, and in response to, the speed of said first motor for driving said article infeed conveyor which is continuously sensed by, and stored within, said control circuit whereby the operations of said first, second, and third motors, as well as said article infeed conveyor, said film moving rollers, and said sealing heads, are always properly and timely coordinated.

2. Apparatus for controlling a driving system in a packaging machine of the type having a former for shaping a film of packaging material, moved past said former, into a continuous tube; an article infeed conveyor adapted to feed articles, to be packaged within said former, into said continuous tube of said packaging material; a pair of rollers for moving said film of packaging material toward said former and toward an end seal mechanism; and a pair of sealing heads at said end seal mechanism for sealing and cutting said continuous tube of packaging material, comprising:

first motor means for driving said article infeed conveyor;

second motor means for driving said rollers for moving said film;

third motor means for driving said sealing heads;

said first, second, and third motor means forming said driving system of said packaging machine; and control circuit means for continuously sensing and storing speed data from said first motor means for driving said article infeed conveyor and for continuously generating a film speed control signal and a sealing head speed control signal for controlling the speed of said second motor means for driving said rollers for moving said film, and the speed of said third motor means for driving said sealing heads, respectively, at a speed value which is continously dependent upon, and in response to, the speed of said first motor means for driving said article infeed conveyor which is continuously sensed by, and stored within, said control circuit means whereby the operations of said first, second, and third motor means, as well as said article infeed conveyor, said film moving rollers, and said sealing heads, are always properly and timely coordinated.

3. A method a set forth in claim 1, further including the steps of:

providing rotary encoder means in association with said second and third motors for driving said film rollers and said sealing heads, respectively, for detecting the speed of said second and third motors; and feeding said detected speed values of said second and third motors back to said control circuit so as to establish with said control circuit closed loop servo systems.

4. Apparatus as set forth in claim 2, further comprising:

rotary encoder means operatively associated with said second and third motor means for driving said film rollers and said sealing heads, repsectively, for detecting the speed of said second and third motor means; and means interconnecting said rotary encoder means with said control circuit means for transmitting said detected speed values of said second and third motor means back to said control circuit means so as to define with said control circuit means closed loop servo control system.

* * * * *